US009586154B2

(12) United States Patent
Lau et al.

(10) Patent No.: US 9,586,154 B2
(45) Date of Patent: Mar. 7, 2017

(54) TOY RACETRACK WITH MOVEABLE OBSTACLE

(71) Applicant: Mattel, Inc., El Segundo, CA (US)

(72) Inventors: Kit Hong Lau, Wan Chai (HK); Steve Moran, El Segundo, CA (US); Stacy O'Connor, El Segundo, CA (US); Brendon Vetuskey, Long Beach, CA (US); Jacky Xie, Shen Zhen (CN)

(73) Assignee: Mattel, Inc., El Segundo, CA (US)

( * ) Notice: Subject to any disclaimer, the term of this patent is extended or adjusted under 35 U.S.C. 154(b) by 138 days.

(21) Appl. No.: 14/504,895

(22) Filed: Oct. 2, 2014

(65) Prior Publication Data

US 2015/0097043 A1 Apr. 9, 2015

Related U.S. Application Data

(60) Provisional application No. 61/886,201, filed on Oct. 3, 2013.

(51) Int. Cl.

| | |
|---|---|
| ***A63H 18/02*** | (2006.01) |
| ***A63H 18/14*** | (2006.01) |
| ***A63H 18/16*** | (2006.01) |

(52) U.S. Cl.

CPC ..... *A63H 18/026* (2013.01); *A63H 18/028* (2013.01); *A63H 18/14* (2013.01); *A63H 18/16* (2013.01)

(58) Field of Classification Search

CPC .... A63H 18/028; A63H 18/02; A63H 18/023; A63H 18/08; A63H 17/008; A63H 18/00; A63H 18/025; A63H 18/04; A63H 18/16; A63H 18/026; A63H 18/14

See application file for complete search history.

(56) References Cited

U.S. PATENT DOCUMENTS

| | | | |
|---|---|---|---|
| 2,756,687 | A | 7/1956 | Fields |
| 3,562,950 | A | 2/1971 | Gennin |
| 3,621,602 | A | 11/1971 | Barcus et al. |
| 3,633,308 | A | 1/1972 | Yang |
| 3,775,897 | A | 12/1973 | Soulakis et al. |
| 3,858,875 | A | 1/1975 | Nemeth et al. |
| 3,908,989 | A | 9/1975 | Meyer |
| 4,519,789 | A | 5/1985 | Halford et al. |
| 4,536,168 | A | 8/1985 | Stephens |
| 4,558,867 | A | 12/1985 | Hippely |
| 4,715,843 | A | 12/1987 | Ostendorff et al. |

(Continued)

*Primary Examiner* — Mark Le

(74) *Attorney, Agent, or Firm* — Edell, Shapiro & Finnan, LLC

(57) ABSTRACT

A toy racetrack having an obstacle that is moved into and out of the path of a toy vehicle travelling along the racetrack is provided. The racetrack includes a closed loop track and may include a booster mechanism for propelling a toy vehicle along the track. The obstacle may be formed by a movable web or net with an opening that can be used to catch a toy vehicle traveling along the track. A support tower is located adjacent the track, and an obstacle carrier, optionally including an action figure, is movably mounted to the support tower. The figure holds the net, and the figure and net are movable between a raised position and a lowered position. When the net is in its lowered position, a toy vehicle traveling along the track is captured by the net when the net is manually positioned in a capture position.

19 Claims, 15 Drawing Sheets

(56) References Cited

U.S. PATENT DOCUMENTS

| | | | | |
|---|---|---|---|---|
| 5,102,133 | A | 4/1992 | Chilton et al. | |
| 5,683,298 | A | 11/1997 | Jackson | |
| 6,676,480 | B2 | 1/2004 | Sheltman | |
| 6,913,508 | B2 | 7/2005 | Hornsby et al. | |
| 7,628,674 | B2 | 12/2009 | Nuttall et al. | |
| 7,637,796 | B2 | 12/2009 | Hippely | |
| 7,690,964 | B2 | 4/2010 | Nuttall et al. | |
| 7,794,301 | B2 | 9/2010 | Ostendorff et al. | |
| 7,819,720 | B2 | 10/2010 | Nuttall et al. | |
| 7,857,679 | B2 | 12/2010 | O'Connor et al. | |
| 7,901,266 | B2 | 3/2011 | Ostendorff | |
| 7,934,970 | B2 | 5/2011 | O'Connor | |
| 8,182,308 | B2 | 5/2012 | Payne | |
| 8,192,246 | B2 | 6/2012 | Ostendorff et al. | |
| 8,221,184 | B2 | 7/2012 | Nuttall et al. | |
| 8,251,768 | B2 | 8/2012 | Nuttall | |
| 8,256,721 | B2 | 9/2012 | O'Connor et al. | |
| 8,267,738 | B2 | 9/2012 | Nuttall | |
| 8,298,035 | B2 | 10/2012 | O'Connor | |
| 8,322,660 | B2 | 12/2012 | O'Connor | |
| 8,323,069 | B2 | 12/2012 | Nuttall et al. | |
| 8,430,712 | B2 | 4/2013 | O'Connor et al. | |
| 2005/0287914 | A1 | 12/2005 | Sheltman et al. | |
| 2005/0287915 | A1 | 12/2005 | Sheltman et al. | |
| 2005/0287919 | A1 | 12/2005 | Sheltman et al. | |
| 2011/0086574 | A1* | 4/2011 | Nuttall ..... | A63H 18/028 446/429 |
| 2011/0101120 | A1* | 5/2011 | O'Connor ..... | A63H 18/028 238/10 A |
| 2011/0294396 | A1 | 12/2011 | O'Connor et al. | |
| 2012/0052766 | A1 | 3/2012 | Payne | |
| 2012/0164914 | A1 | 6/2012 | O'Connor et al. | |
| 2013/0109271 | A1 | 5/2013 | Ferreyra et al. | |

* cited by examiner

TOY RACETRACK WITH MOVEABLE OBSTACLE

CROSS-REFERENCE TO RELATED APPLICATIONS

This application is based upon and claims priority from co-pending U.S. Provisional Patent Application Ser. No. 61/886,201 entitled "Toy Racetrack With Moveable Figure and Obstacle," filed with the United States Patent and Trademark Office on Oct. 3, 2013, the entire disclosure of which is incorporated herein by reference in its entirety.

FIELD OF THE INVENTION

The present invention relates to toy racetracks, and more particularly to a racetrack for toy vehicles having a moveable obstacle that is moveable into and out of the race pathway and selectively manipulated to capture a toy vehicle travelling along the racetrack.

BACKGROUND

Toy racetracks are popular among children of varied ages, and a variety of track configurations have previously been provided that include various features, such as traps, loops, stunts, and the like to add to the excitement a child experiences while playing with the toy. For instance, toy racetracks have been provided having varied track sections and obstacles that intersect a toy vehicle's path as it traverses the track loops and that can vary position or orientation during or resulting from interaction with a toy vehicle.

For example, U.S. Pat. No. 4,519,789 to Halford et al. discloses a toy racetrack having a swinging hoop through which a toy vehicle must pass as it traverses the racetrack.

Similarly, U.S. Pat. No. 7,628,674 to Nuttall et al. discloses a toy racetrack including gauntlet features intersecting the toy vehicle's path and that, when triggered, may project the toy vehicle away from the track or move to capture the toy vehicle at a specific location along the track.

Likewise, U.S. Pat. No. 7,637,796 to Hippely discloses a toy racetrack including an obstacle positioned within the toy vehicle path that may be selectively deployed to obstruct the toy vehicle.

Further, U.S. Pat. No. 7,819,720 to Nuttall et al. discloses a toy racetrack including an indexing stunt selector that places differing stunt elements into the path of the toy vehicle in response to the toy vehicle passing over elements of the racetrack.

Still further, U.S. Patent Application Pub. No. 2011/0294396 of O'Connor et al. discloses a toy racetrack having a capture device that captures a toy vehicle as it travels along a specific one of multiple toy vehicle paths.

The specifications of each of the foregoing are hereby incorporated by reference in their entireties.

While the foregoing configurations do provide varied obstacle and stunt features, there remains an ongoing need to provide toy racetrack features capable of maintaining the interest of a child and increasing the excitement and amusement they experience when playing with a toy racetrack. It would therefore be advantageous to provide a toy racetrack that further enhances the excitement and amusement offered to a child as they engage in such play, and more particularly that includes a user-manipulated obstacle that requires the user to properly time the positioning or orientation of the obstacle and that will allow a toy vehicle to continue through the track if the positioning or orienting of the obstacle is not properly timed.

SUMMARY OF THE INVENTION

Disclosed is a toy racetrack having a moveable obstacle that is moved into and out of the path of a toy vehicle travelling along the racetrack and that is selectively capable of interacting with the toy vehicle. In one embodiment of the invention, the obstacle is carried by a moveable figure, such as an action figure. The racetrack comprises a closed loop track, and may include a booster mechanism for propelling a toy vehicle along the track. The track includes a gap proximate to which is an obstacle, which in accordance with certain embodiments may comprise a movable web or net with an opening that can be used to catch a toy vehicle traveling along the track in the area of the gap. A support tower is located proximate to the gap, and a carrier, which may include a figure, is movably mounted to the support tower. The figure holds the net, and the figure and net are movable between a raised position and a lowered position. When the net is in its lowered position, the net is located in the gap and a toy vehicle traveling into the gap may be captured by the net when the net is positioned by a user into a capture position. If the user's positioning of the net in the capture position is properly timed, the toy vehicle will be captured in the net; if not properly timed, the toy vehicle will pass through the net, escaping the obstacle trap and continuing on its path through the racetrack. After the toy vehicle's capture, other toy vehicles on the racetrack may continue through the racetrack without encountering the obstacle.

BRIEF DESCRIPTION OF THE DRAWINGS

The numerous advantages of the present invention may be better understood by those skilled in the art by reference to the accompanying drawings in which.

Figure 2:
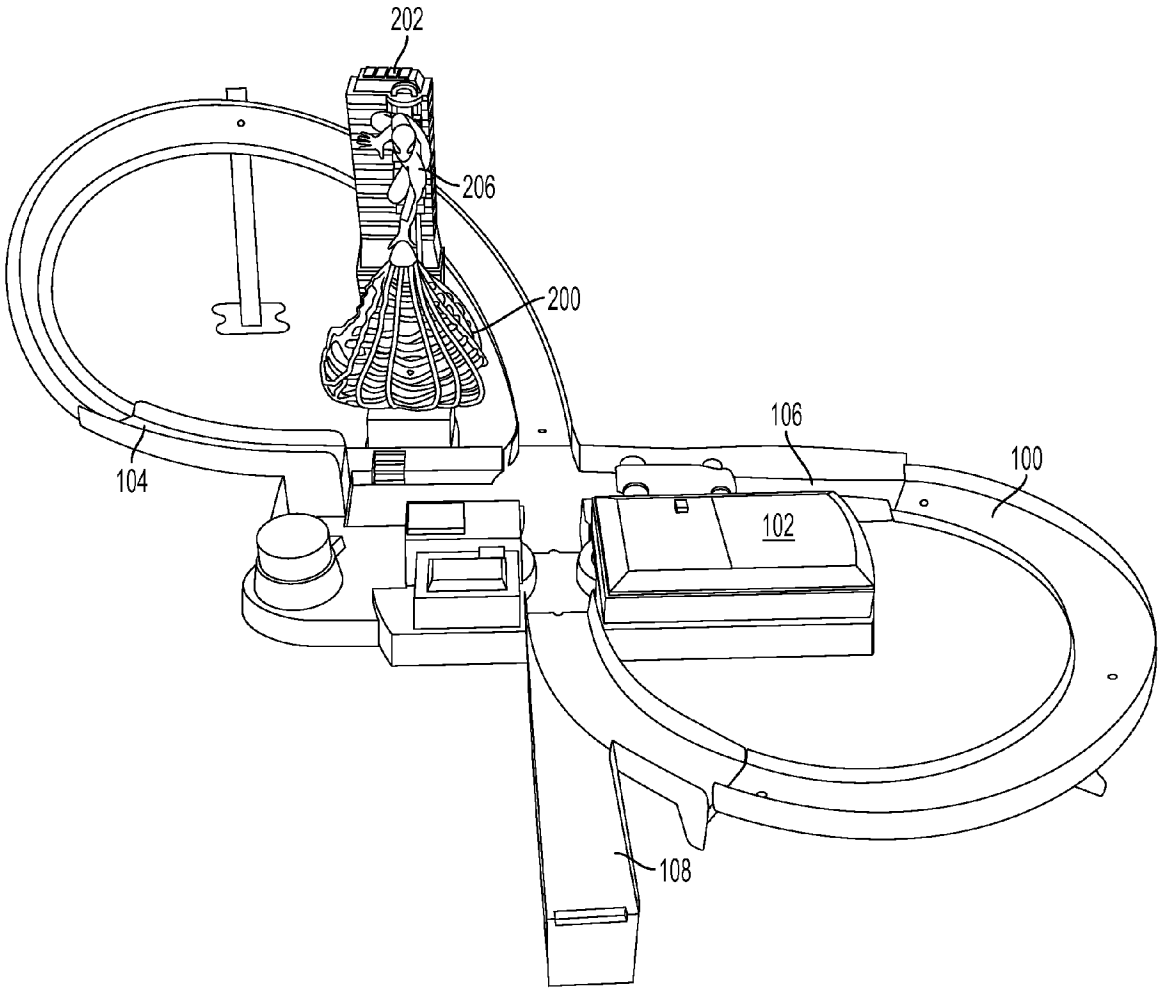
FIG. 2 is a perspective view of a toy racetrack in accordance with further aspects of an embodiment of the invention.

FIGS. **8*a*-8*e* are schematic views of various positions of the carrier, figure, and obstacle of FIG. 2**.

Figure 9:
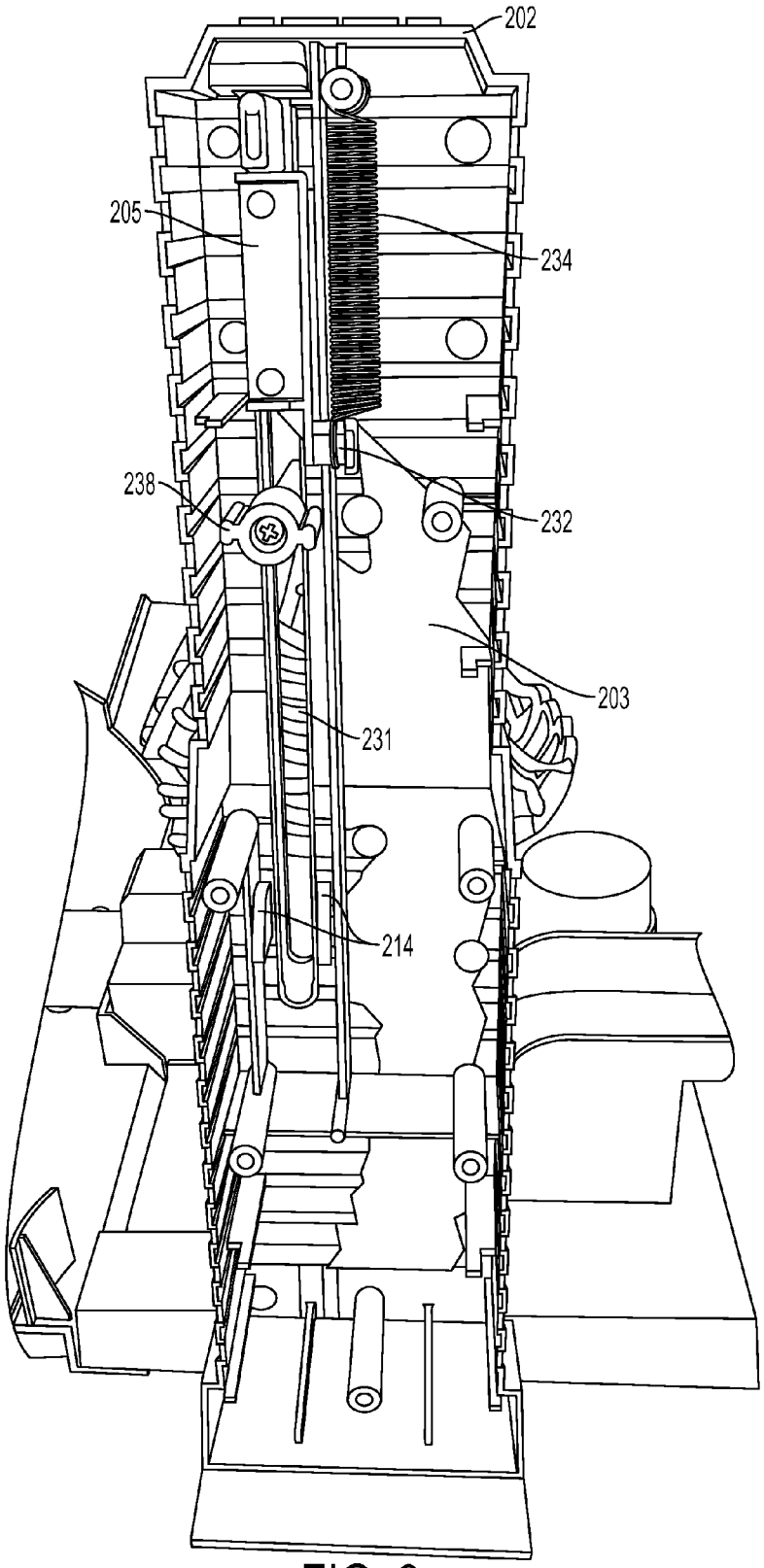

FIG. 9 is a rear, sectional view of the tower support of FIG. 2.

Figure 10:
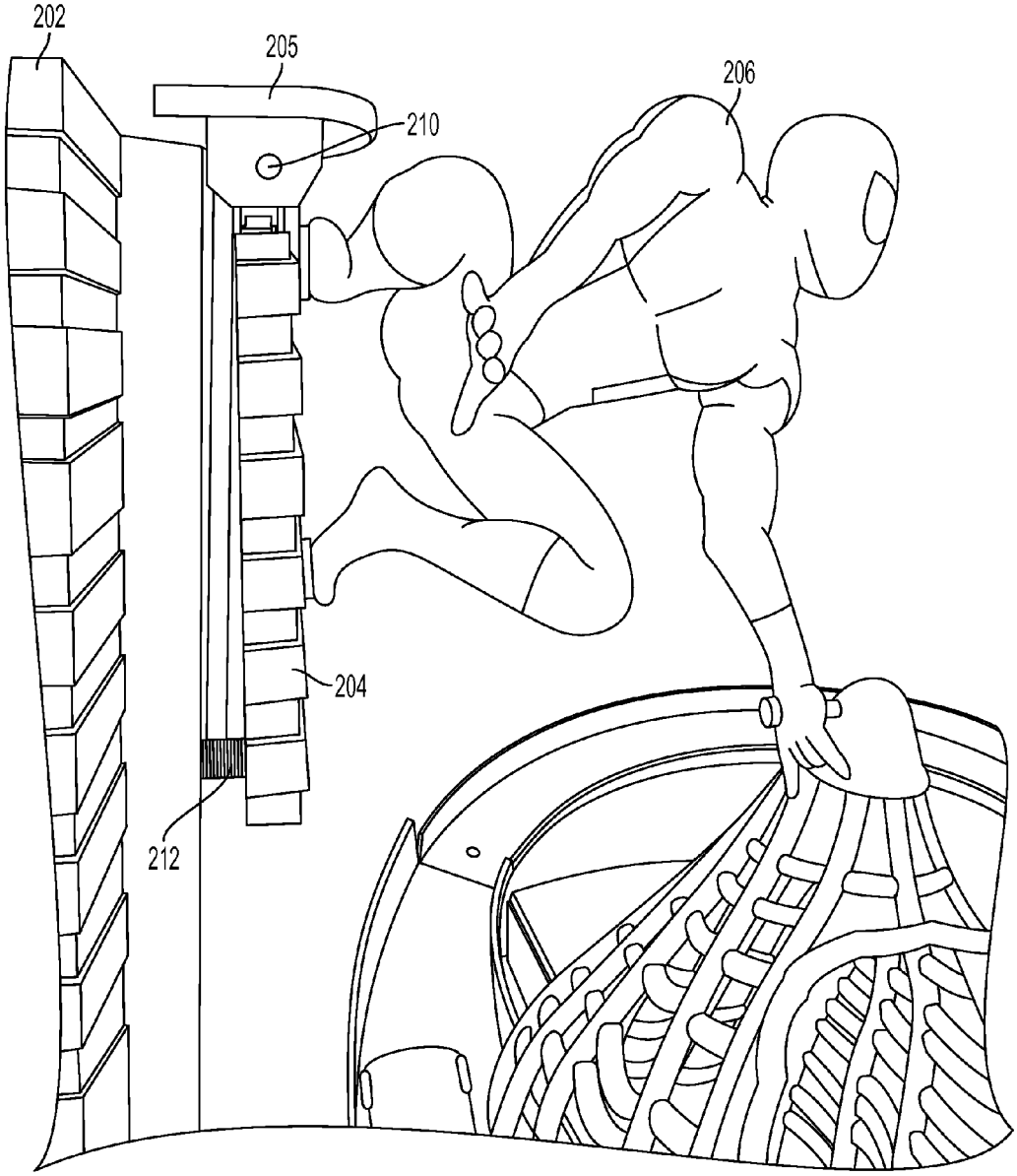

FIG. 10 is a close-up side view of the figure, carrier, and obstacle of FIG. 2.

Figure 11:
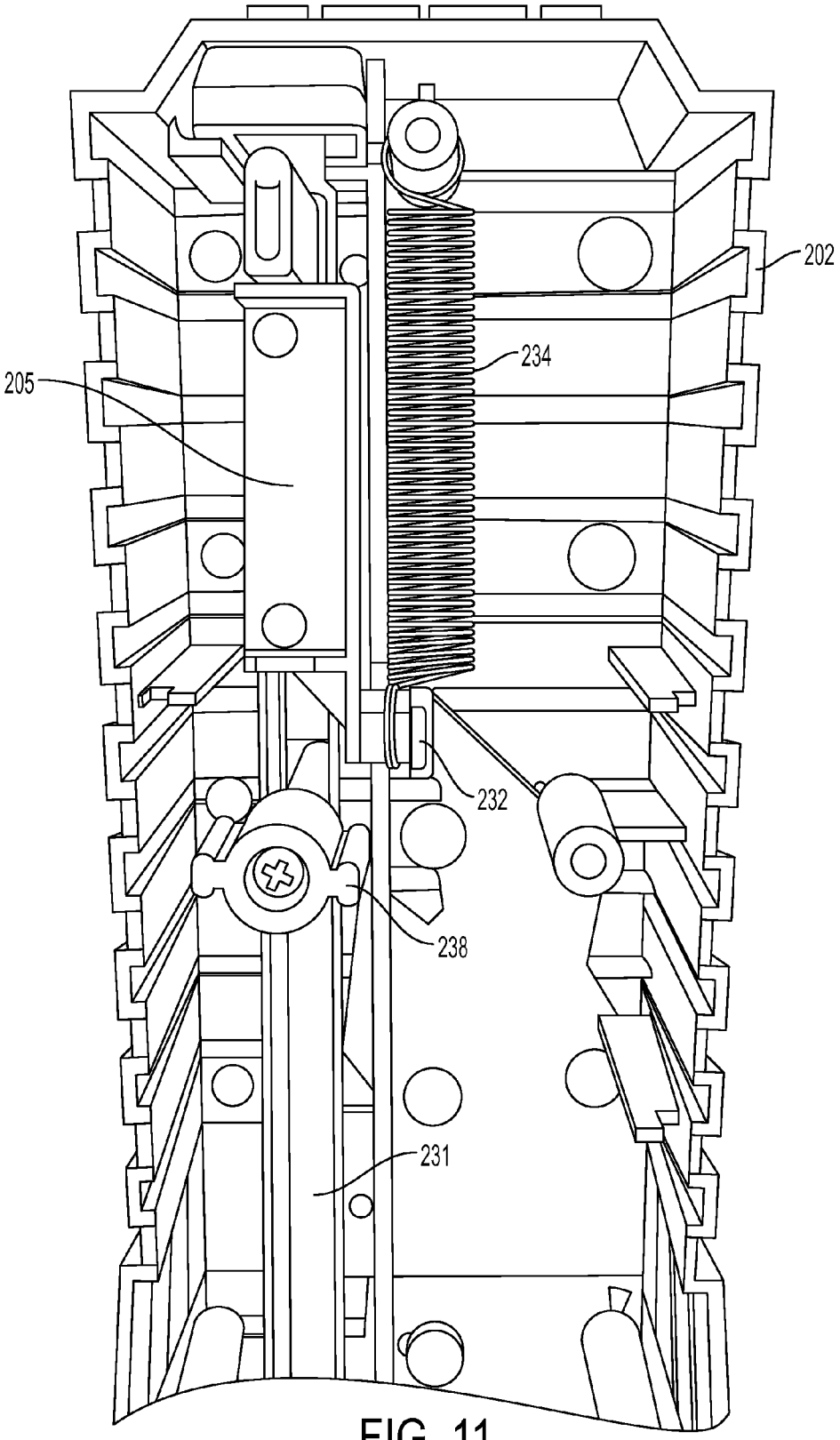

FIG. 11 is a rear, close-up sectional view of the tower support of FIG. 2 showing the carrier in its raised position.

Figure 12:
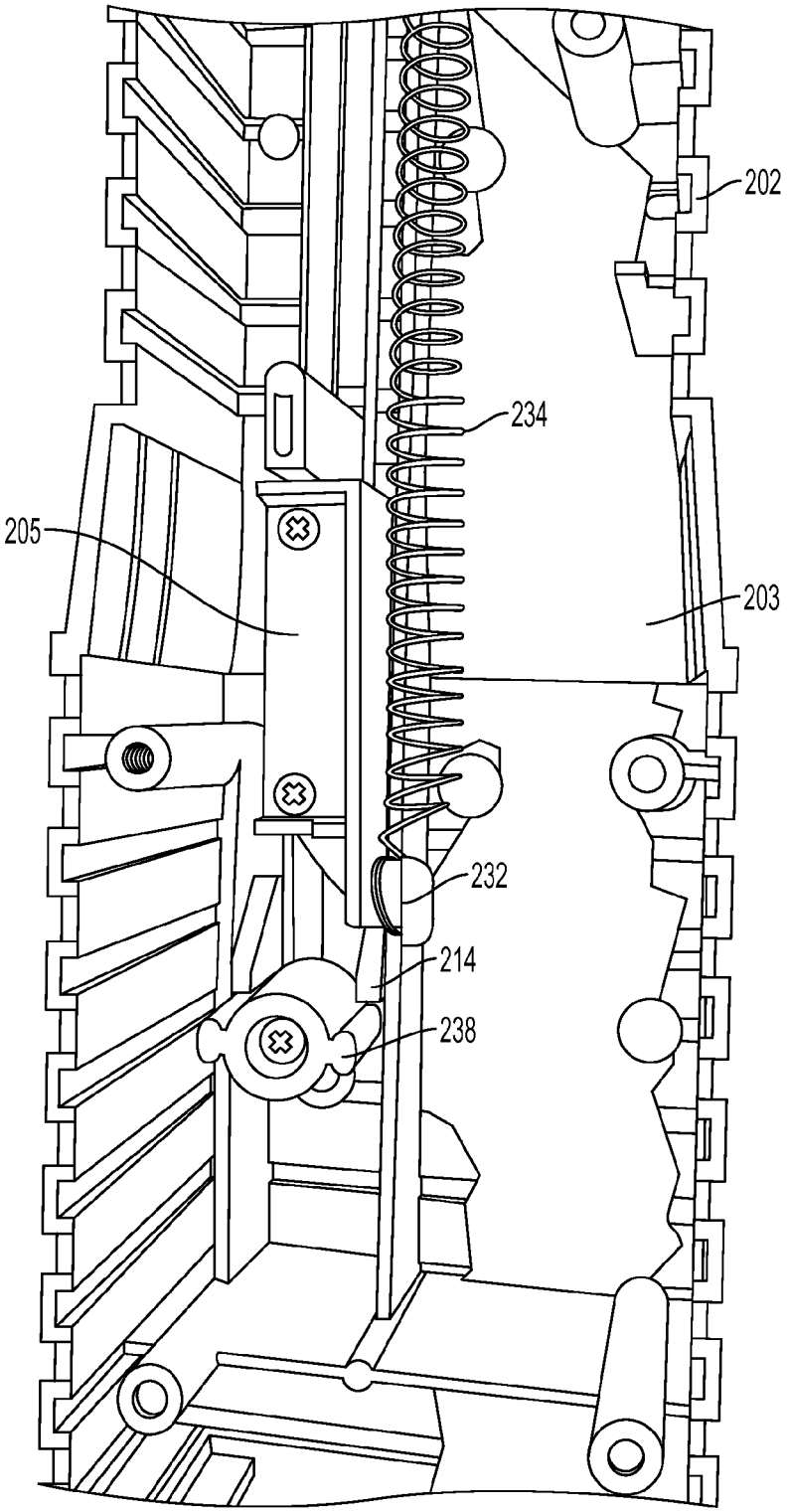

FIG. 12 is a rear, close-up sectional view of the tower support of FIG. 2 showing the carrier in its lowered position.

Figure 13:
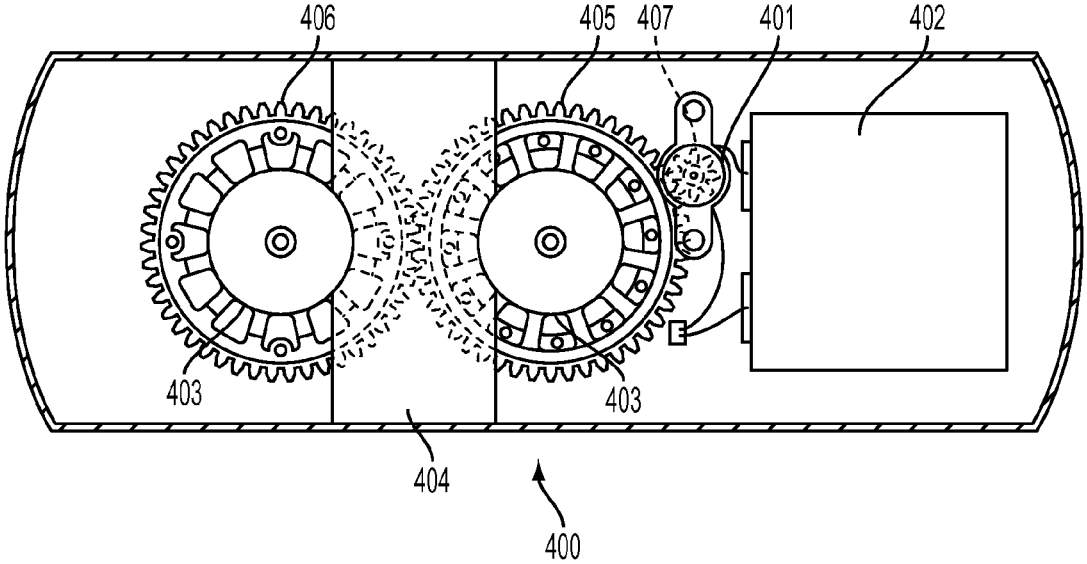

FIG. 13 is a top, sectional view of the motorized booster mechanism of FIG. 2.

Figure 14:
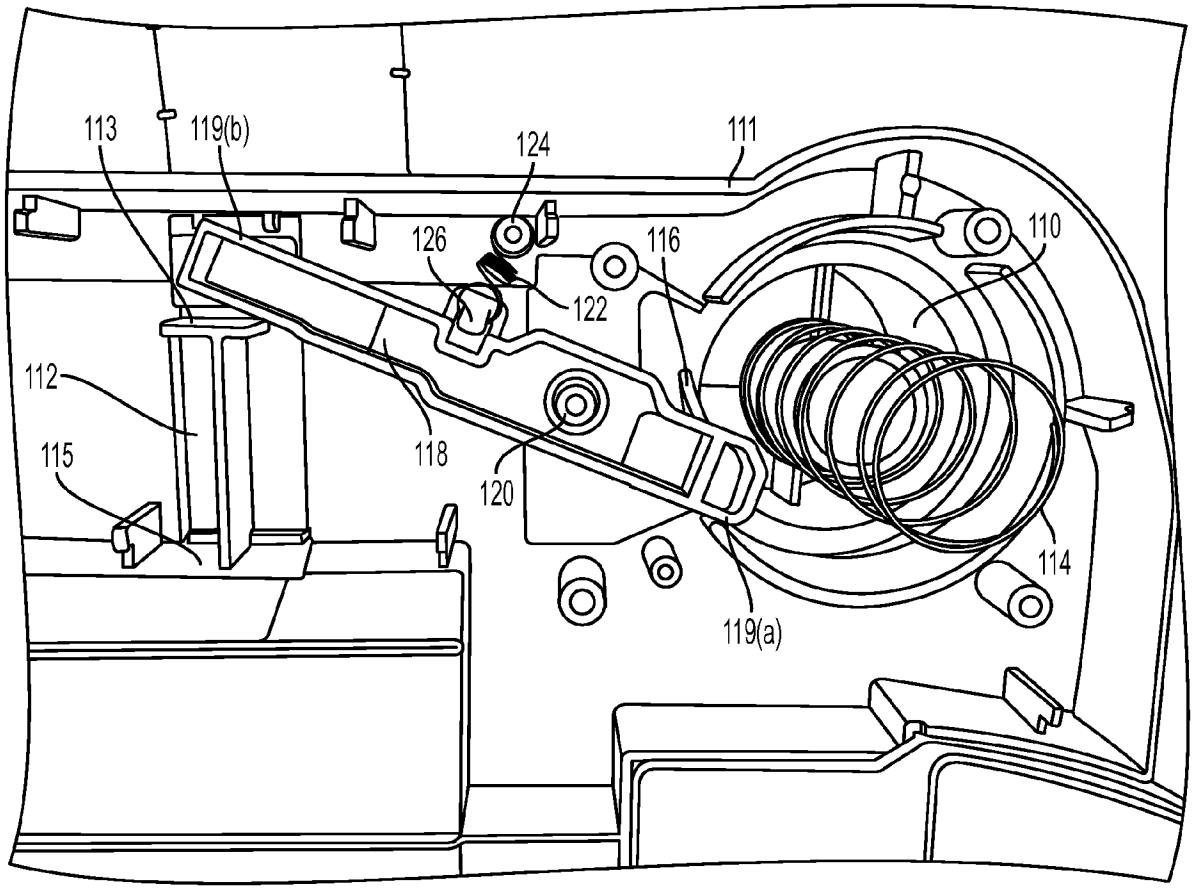

FIG. 14 is a bottom, sectional view of an actuator assembly for use with the toy racetrack of FIG. 2 showing a push lever in a retracted position.

Figure 15:
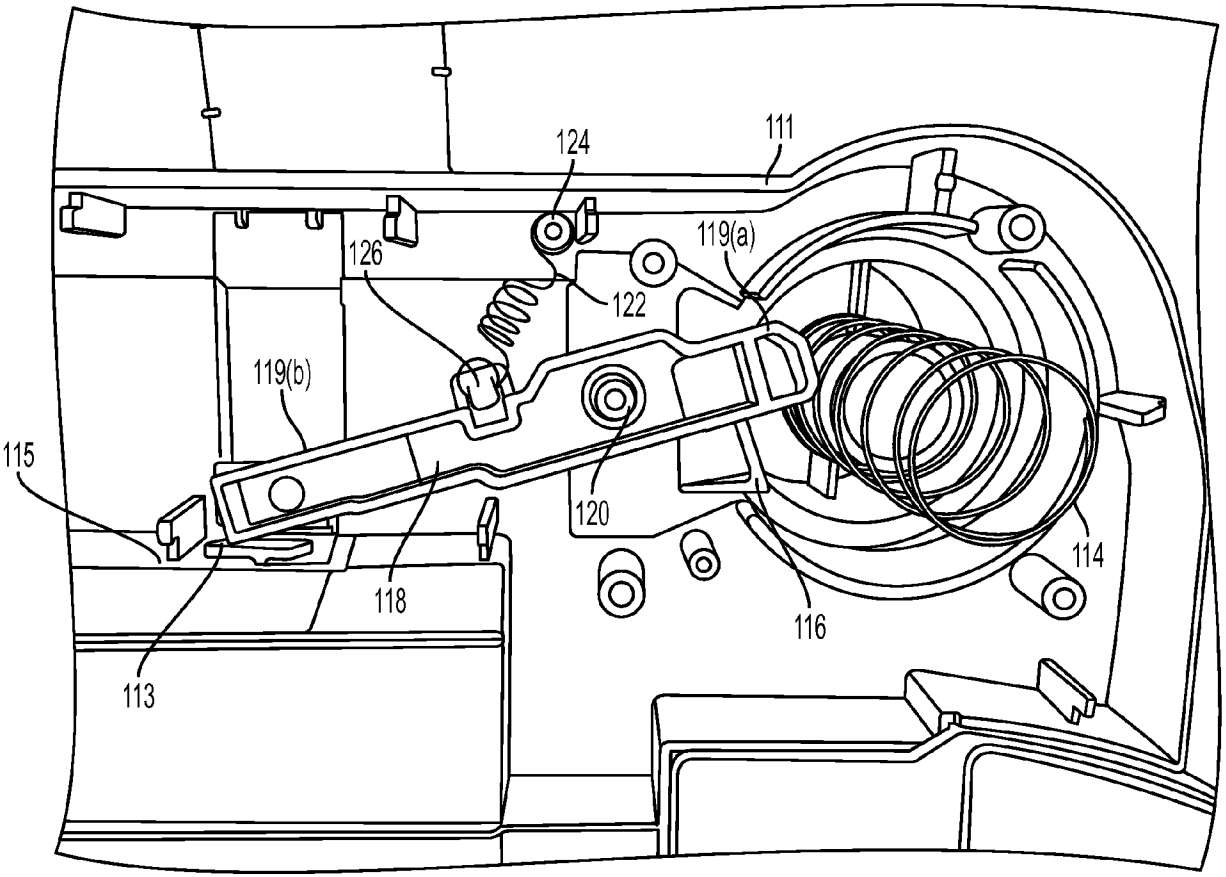

FIG. 15 is a bottom, sectional view of the actuator assembly of FIG. 14 with the push lever in an extended position.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
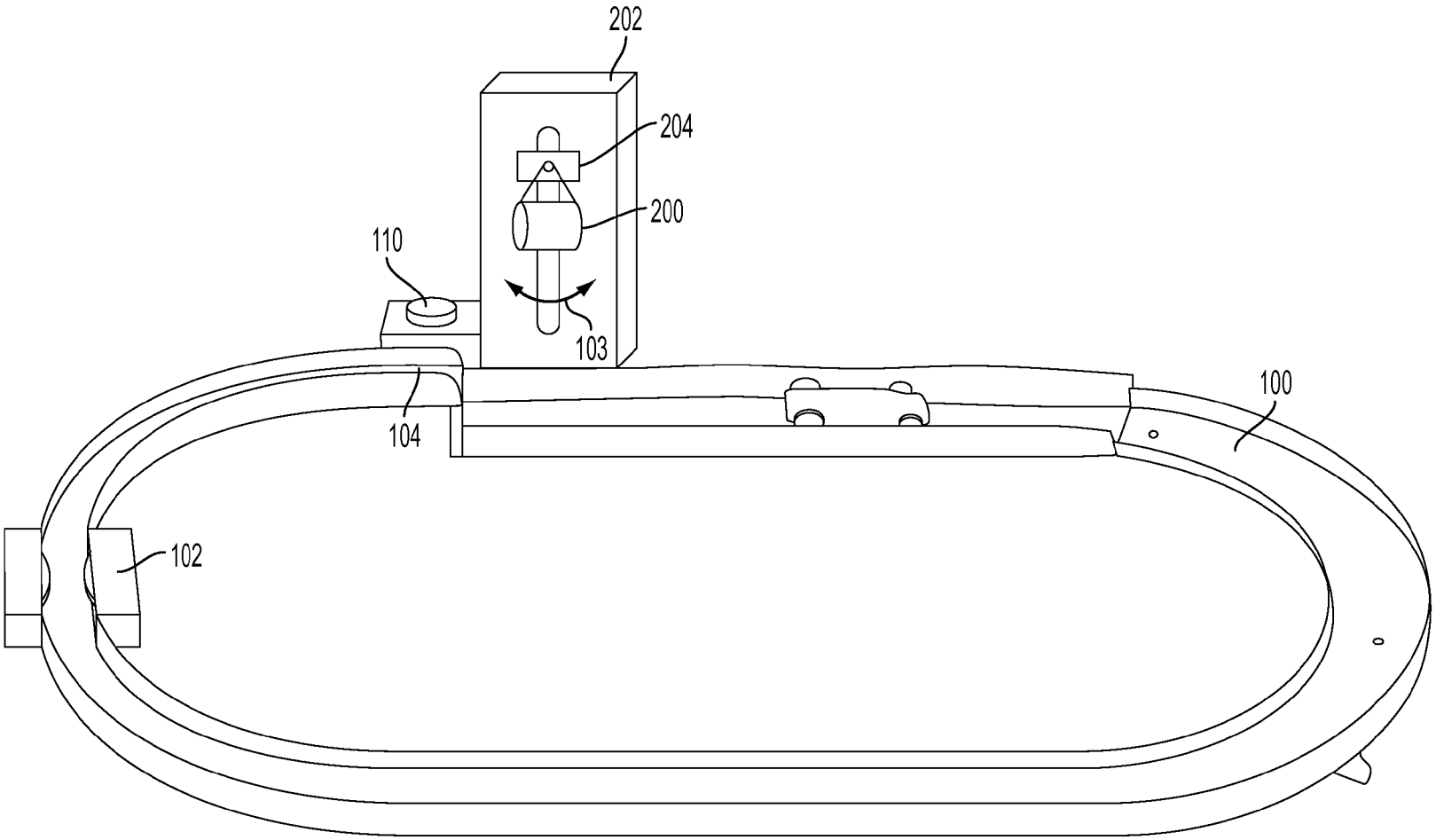
FIG. 1 is a perspective view of a toy racetrack in accordance with certain aspects of an embodiment of the invention.

FIG. 1 is a perspective view of a toy racetrack in accordance with certain aspects of an embodiment of the invention. A toy racetrack, such as an endless loop racetrack 100 formed of connected sections of extruded plastic track, is provided and may include a motorized booster mechanism 102 that will push toy vehicles, such as die cast metal cars, through the endless loop 100. Endless loop 100 includes a ramp portion 104 that raises a portion of the path traveled by a toy vehicle, with the continuing track immediately adjacent the ramp 104 being at a lower elevation so as to create a "jump" for a toy vehicle travelling through endless loop 100. An obstacle 200 is also provided and is moveable into and out of the path of the toy vehicles as they travel along endless loop 100. A tower 202 extends up from endless loop racetrack 100, and a carrier 204 is vertically moveable along tower 202 and carries obstacle 200. Obstacle 200 is pivotably mounted to carrier 204, and can thus swing in the direction of arrow 103.

When a user engages an actuator 110 with obstacle 200 positioned in its lowered, track-intercepting position, obstacle 200 is pivoted away from ramp 104. When obstacle 200 is pivoted away from ramp 104 by a sufficient amount, a toy vehicle travelling through obstacle 200 will impact a portion of obstacle 200 that causes a catch within tower 202 to release carrier 204, allowing it to spring upward (while carrying the toy vehicle in obstacle 200) and out of the pathway of endless loop 100. If other toy vehicles are travelling along endless loop 100, they are then free to continue while avoiding the trap created by obstacle 200.

FIG. 2 is a perspective view of a toy racetrack in accordance with further aspects of an embodiment of the invention. As in FIG. 1, a toy racetrack, such as an endless loop racetrack 100 formed of connected sections of extruded plastic track, is provided and may include a motorized booster mechanism (shown generally at 102) that will push toy vehicles, such as die cast metal cars, through the endless loop.

As known in the related arts and with reference to FIG. 13, the booster is configured to accelerate the toy vehicle along the tracks of the toy. In one non-limiting embodiment, the booster is powered by a motor 401 connected to a power source 402, such as a battery pack, that is coupled to one or more booster wheels 403 that are arranged in the track path 404. The booster wheels may be made of rubber (PVC), foam, or other materials known in the art. In one embodiment, a single wheel may be employed or two oppositely disposed wheels may be employed. The motor 401, which may be a 6-volt electric motor, rotates the booster wheels through drive gears 405, 406, and 407 at high speeds such that vehicles travelling along the track path contact the rotating wheels and are propelled forward thereby at higher speeds to ensure the return of the vehicles to the inlet of the booster wheels after travelling through the track 100. As such, vehicles travelling through the track 100 may continue to traverse the endless loop as long as booster mechanism 102 is operated, or until the toy vehicle is captured, as discussed in greater detail below.

Figure 3:
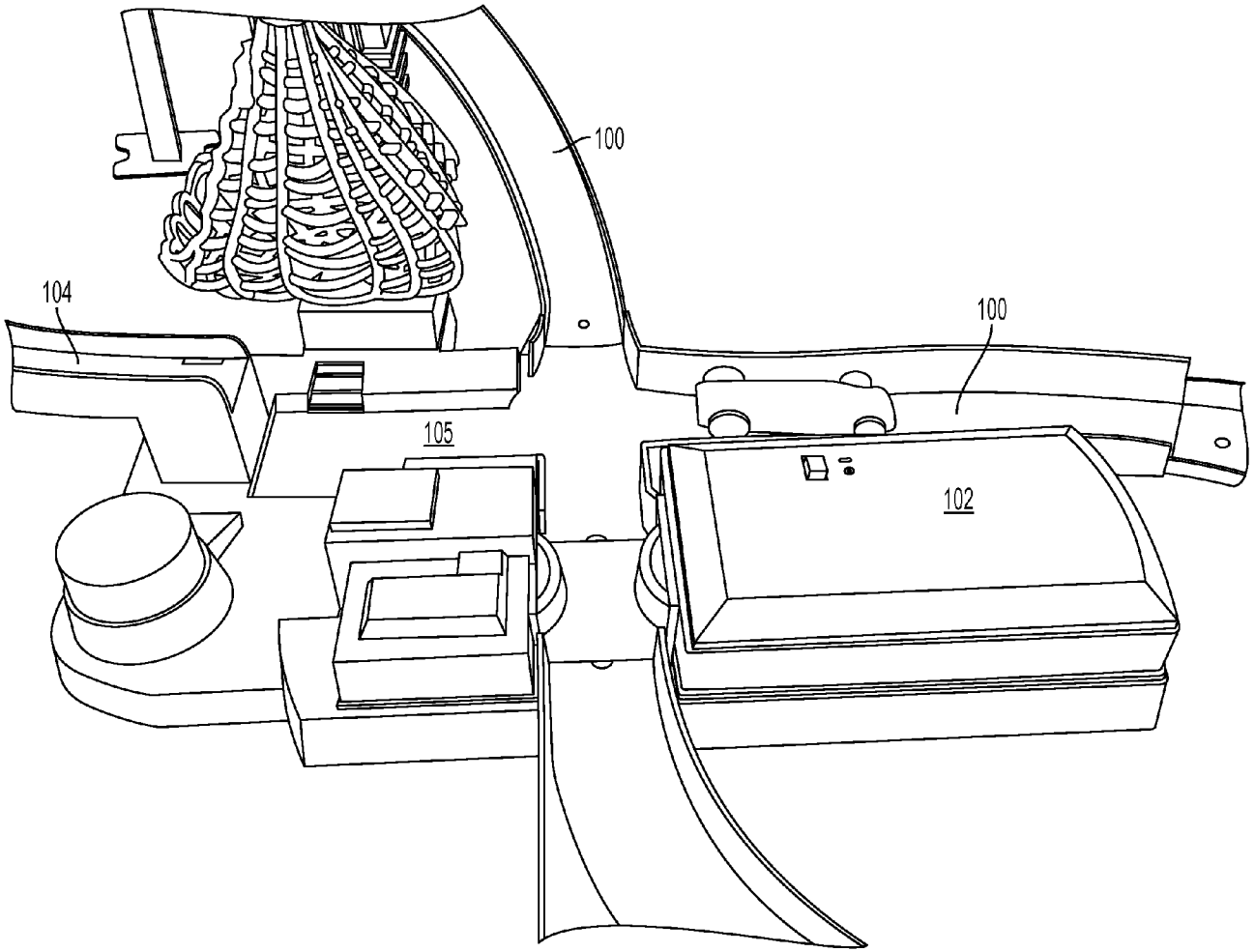
FIG. 3 is a perspective view of a gap portion of the racetrack of FIG. 2.

A portion of the track is provided a ramp 104, with the continuing track portion 105 (shown in FIG. 3) immediately adjacent ramp 104 positioned vertically below ramp 104 so as to form a gap in the racetrack. Thus, as a toy vehicle travels through endless loop racetrack 100, it will launch from ramp 104 and fly briefly through the air until it lands on receiving portion 106 (FIG. 5), and from such landing continue its travel through endless loop racetrack 100. Endless loop racetrack 100 may optionally include one or more track receiver sections 108 that will allow the connection of additional sections of racetrack so as to further customize the track to the user's preferences.

With continued reference to FIG. 2, obstacle 200 is provided and is moveable into and out of the path of the toy vehicles as they travel along endless loop racetrack 100. Tower 202 extends up from endless loop racetrack 100, and carrier 204 (best viewed in FIG. 4) is vertically moveable along tower 202 and carries obstacle 200. A FIG. 206, such as an action figure or comic book character, may be mounted to carrier 204, which in turn is pivotably attached to a moveable carriage 205 (as discussed in greater detail below). Obstacle 200 is also pivotally mounted, such as by pivot connection 208 that is carried by FIG. 206, allowing obstacle 200 to swing about pivot connection 208 and in a direction that is parallel to the travel path of toy vehicles as they launch from ramp 104.

Figure 5:
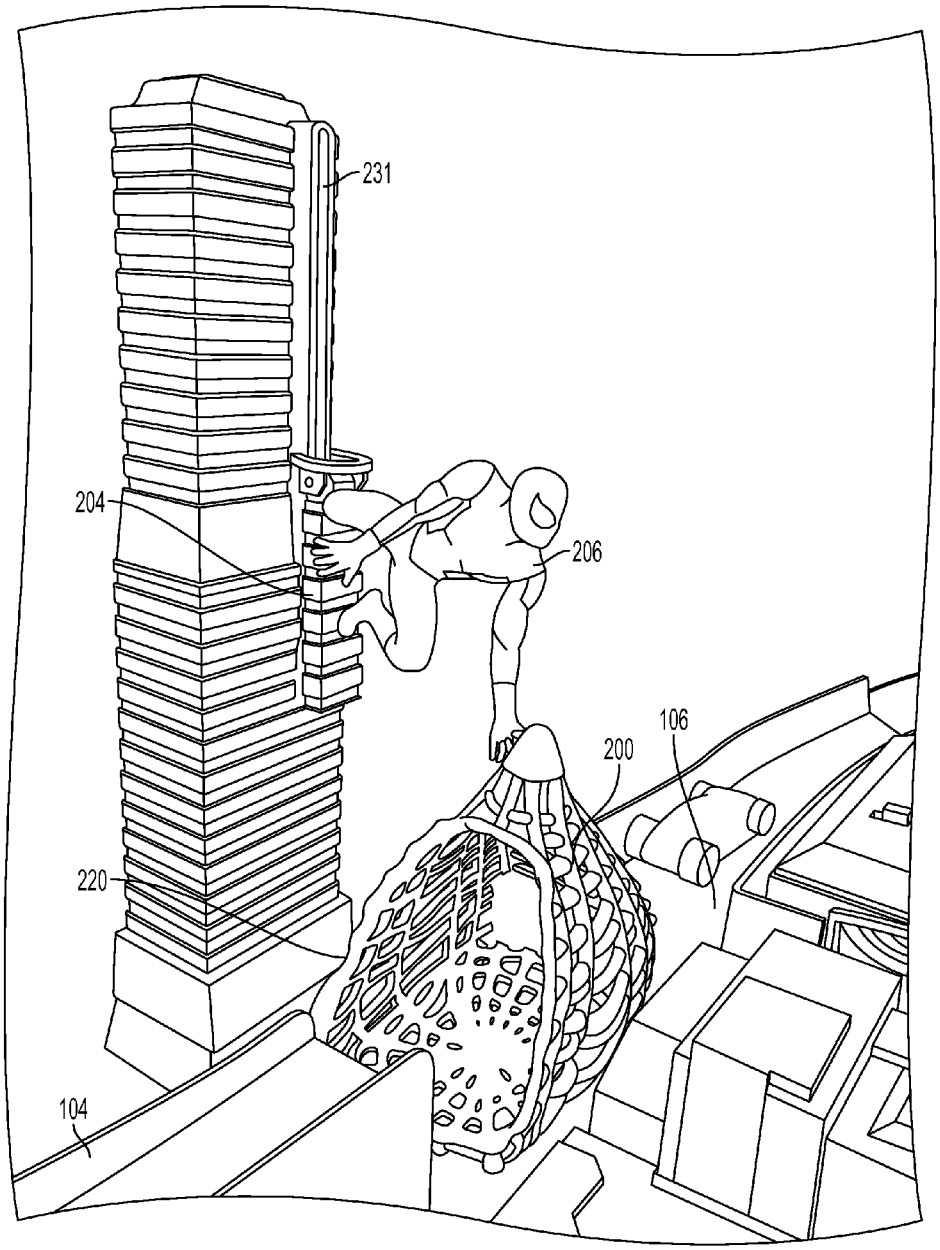
FIG. 5 is a perspective view of the moveable carrier and obstacle of FIG. 2 in their lowered positions.
Figure 6:
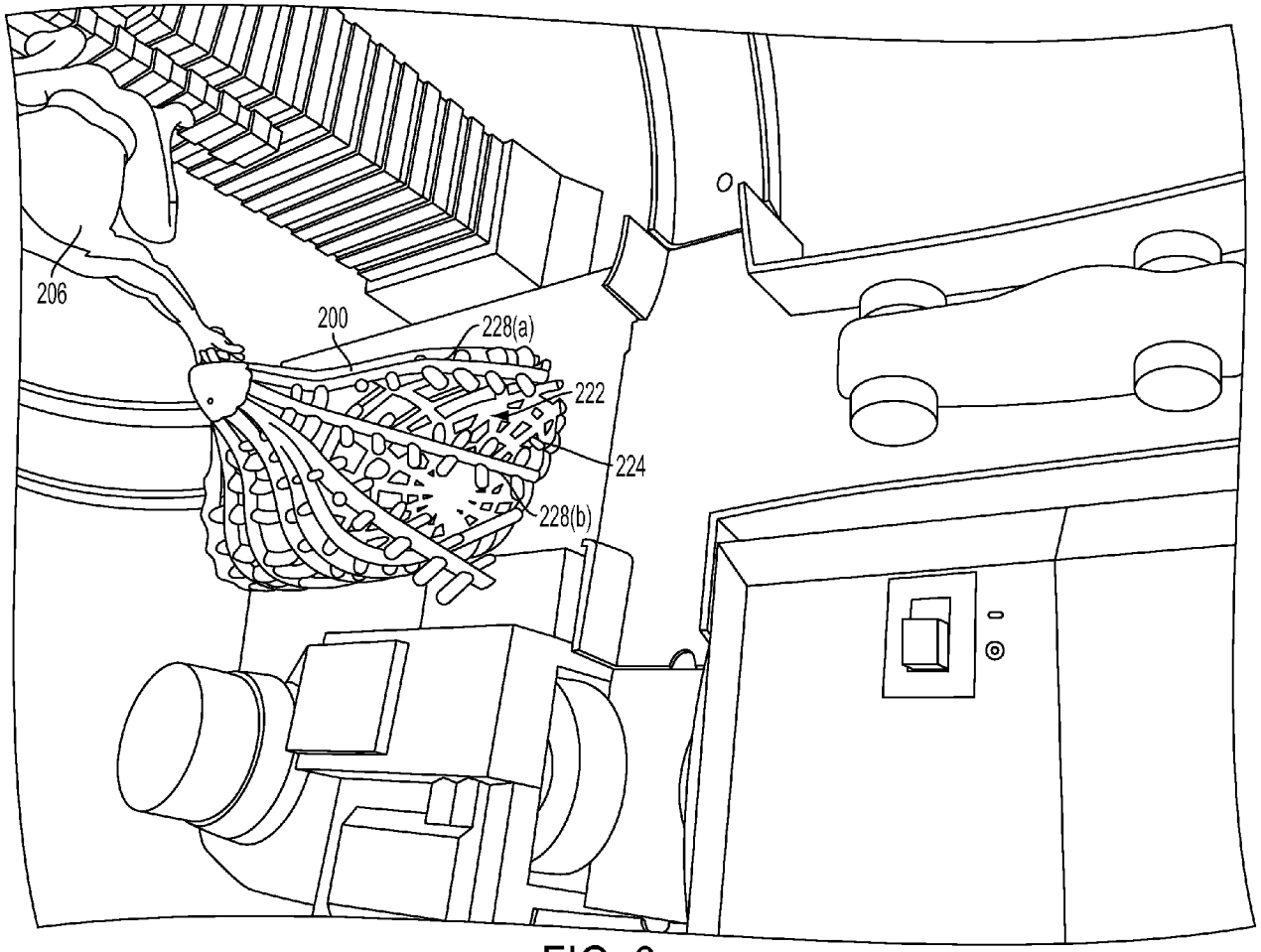
FIG. 6 is a perspective view of the exit side of the obstacle of FIG. 2.

As shown in FIG. 5, FIG. 206 may be lowered so as to position obstacle 200 within the travel path of a toy vehicle as it jumps from ramp 104 toward receiving portion 106. Obstacle 200 has a wide opening 220 on its entrance side, and as shown in FIG. 6, a perforated opening 222 on its exit side, thus allowing a toy vehicle to pass through the obstacle when it sits at rest adjacent ramp 104. However, and with reference to FIG. 7, when a user engages an actuator 110, a push lever 112 extends toward the bottom of obstacle 200, causing obstacle 200 to pivot about pivot connection 208 and away from ramp 104. When obstacle 200 is pivoted away from ramp 104 by a sufficient amount, a toy vehicle travelling through obstacle 200 will strike the front, bottom surface 224 of obstacle 200, causing it to be captured in obstacle 200. The particular surface engaged by the toy vehicle depends on the angle of rotation of the obstacle 200 and the position of the obstacle 200 when the toy vehicle enters the obstacle 200. If the toy vehicle impacts the front, bottom surface 224 of obstacle 200 so as to capture the toy vehicle, the force exerted by the toy vehicle on obstacle 200 will cause carrier 204 to pivot towards carriage 205 and tower 202, releasing an internal catch within tower 202 that holds carriage 205 in place in the lowered position of FIG. 5, and allowing an internal spring to lift carrier 204, FIG. 206, and obstacle 200 (now carrying a toy vehicle) upward and out of the travel path of racetrack 100.

Figure 4:
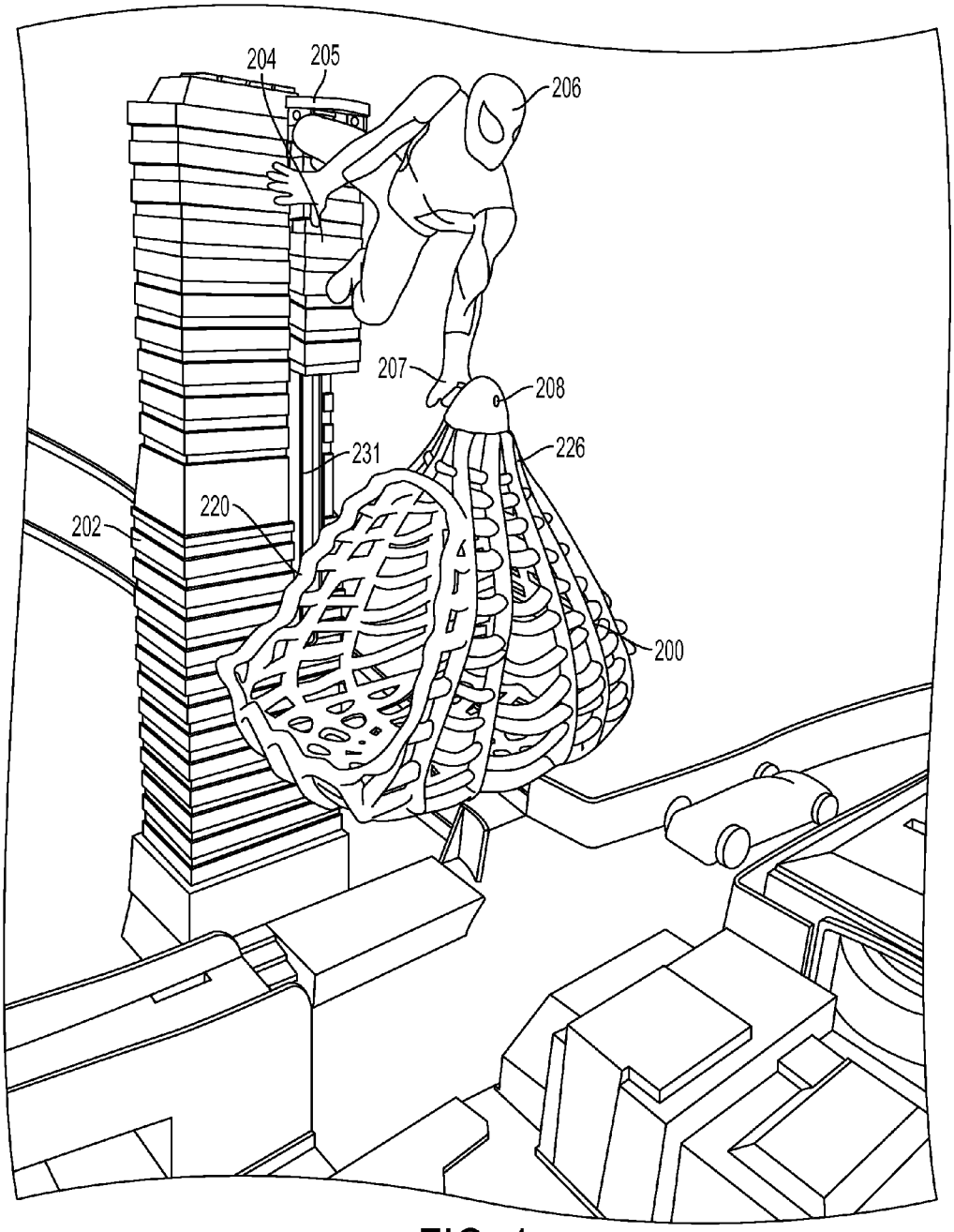
FIG. 4 is a perspective view of the moveable carrier and obstacle of FIG. 2 in their raised positions.

With continued reference to FIGS. 4-6, and in accordance with a particularly preferred embodiment of the invention, obstacle 200 is in the form of a net suspended from the hand of FIG. 206. The net has a tapering neck portion 226 that terminates at pivot connection 208. Pivot connection 208 in turn comprises a pivot pin extending through the top of neck portion 226 and into the hand 207 of FIG. 206. In this configuration, obstacle 200 may freely pivot about pivot connection 208, but will travel vertically into and out of the race path of racetrack 100 as carrier 204, and thus FIG. 206, are carried up and down.

As shown in FIGS. 4 and 5, the opening 220 provided on the entrance side of obstacle 200 is sufficiently large so as to allow a toy vehicle to easily enter obstacle 200 without interfering with the travel of the toy vehicle. More particularly, when carrier 204 and FIG. 206 are in the lowered position shown in FIG. 5, the bottom of opening 220 is no higher than ramp 104, thus allowing easy access by a toy vehicle to the interior of obstacle 200. The opposite, exit side of obstacle 200, however, is segmented having flexible, moveable portions 228(*a*) and 228(*b*). When in an unflexed position, moveable portions 228(*a*) and 228(*b*) preferably sit in contact with one another and with the remainder of obstacle 200 to give the appearance of a contiguous surface. However, when flexed (such as from a toy vehicle passing through obstacle 200 impacting the exit side of obstacle 200), each of moveable portions 228(*a*) and 228(*b*) will be deflected upward and outward, separating from the front, bottom surface 224 of obstacle 200 and away from one another as the toy vehicle passes through. Once the toy vehicle has passed through obstacle 200, moveable portions 228(*a*) and 228(*b*) return to their unflexed positions so that the exit side of obstacle 200 again takes the appearance of a contiguous surface. More than two moveable portions may be provided at the exit side of obstacle 200 configured as above without departing from the spirit and scope of the invention.

Figure 7:
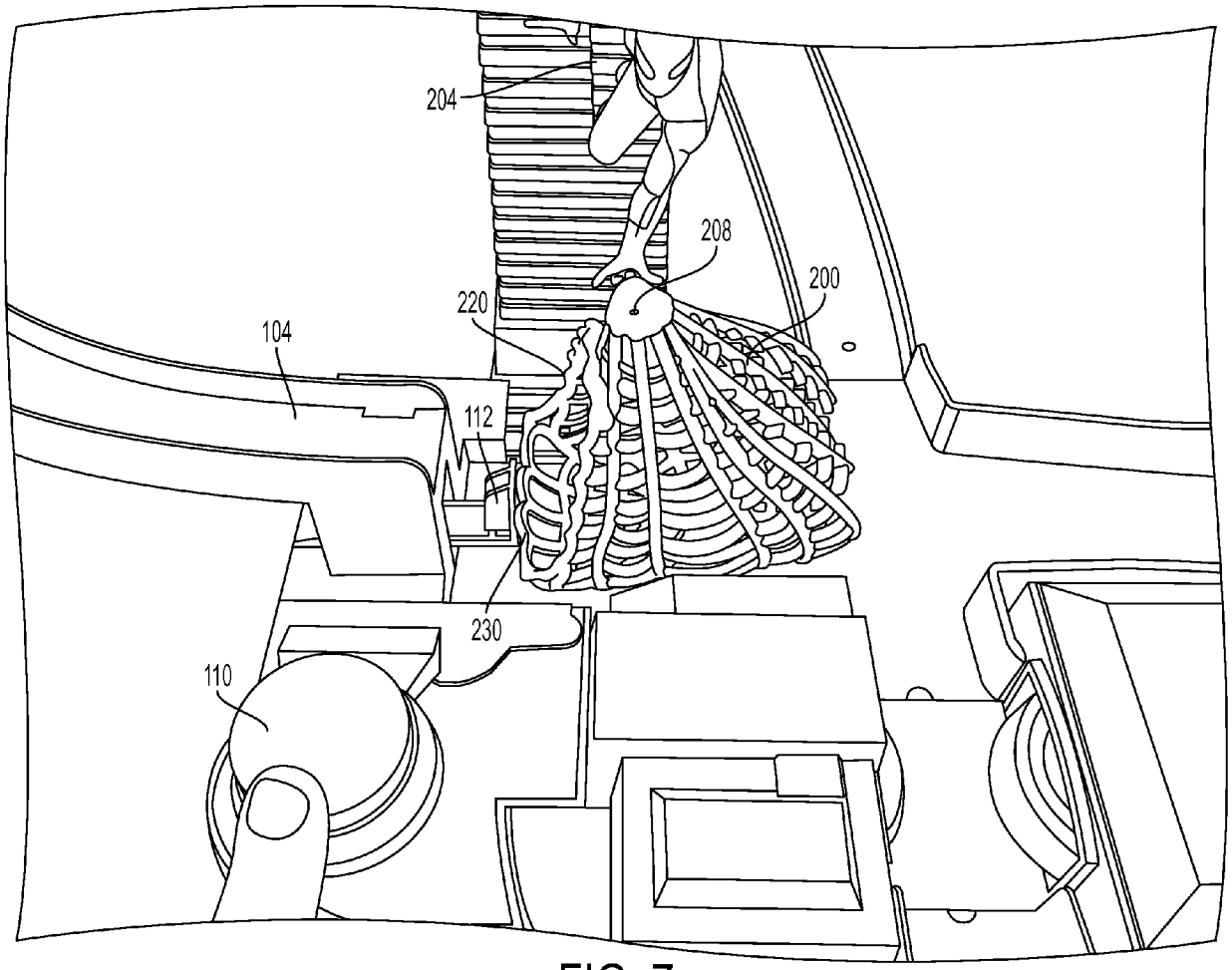
FIG. 7 is a side view of an actuator and push lever for use with the racetrack of FIG. 2.
Figure 8A:
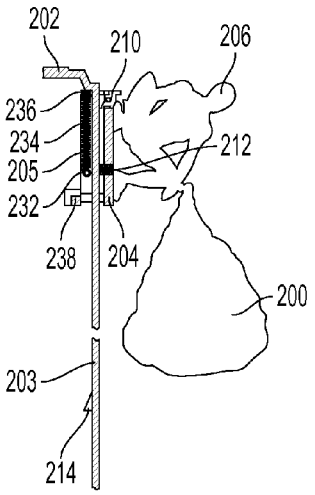
Figure 8B:
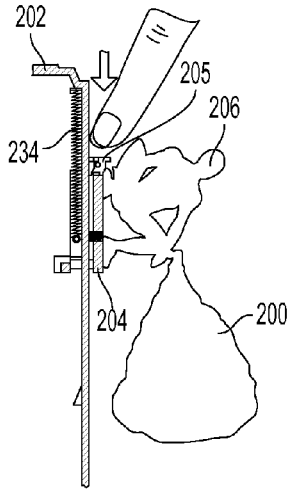
Figure 8C:
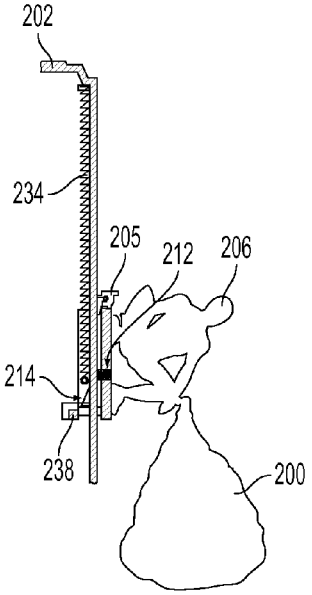
Figure 8D:
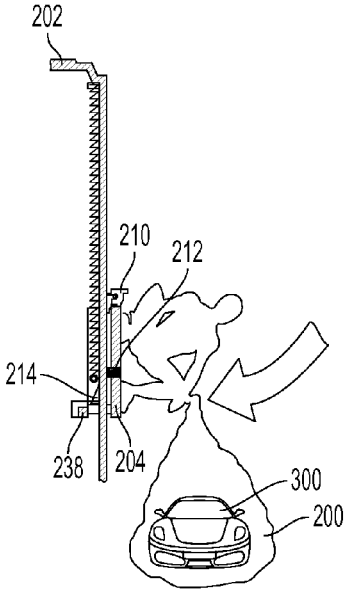
Figure 8E:
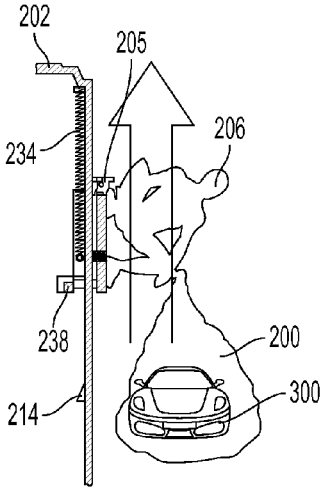

As mentioned briefly above, when obstacle 200 is placed in its lower position shown in FIG. 5, it may be engaged by push lever 112 (operated by actuator 110 through a mechanical linkage, as discussed further below) to pivot about pivot connection 208. With reference to FIG. 7, when obstacle 200 is in such lowered position, the bottom, back portion 230 of obstacle 200 (bordering entrance opening 220) faces push lever 112. Thus, when a user operates actuator 110 to extend push lever 112, the front face of push lever 112 contacts bottom, back portion 230 of obstacle 200, forcing obstacle 200 away from ramp 104 as it pivots about pivot connection 208. The extent to which obstacle 200 pivots away from ramp 104 will depend upon the speed at which the user pushes actuator 110, which in turn will determine the speed at which push lever 112 impacts obstacle 200. The faster that push lever 112 is driven into obstacle 200, the greater the pivot angle that obstacle 200 will achieve.

With reference to FIGS. 14 and 15 and as mentioned briefly above, push lever 112 is operated by actuator 110 through a mechanical linkage positioned in base 111. FIG. 14 is a sectional, bottom view of base 111 showing push lever 112 in the retracted position, and FIG. 15 is a sectional, bottom view of base 111 showing push lever 112 in the extended position. A spring member 114, such as a coil spring, upwardly biases actuator 110 to its ready position in which it may be depressed by a user into base 111 (as shown in FIG. 14). The bottom side of actuator 110 has a downwardly extending, angled cam surface 116 positioned at an edge of the bottom surface of actuator 110. Cam surface 116 aligns with a first end of pivot bar 118, which pivot bar 118 extends from actuator 110 to push lever 112. Pivot bar 118 is pivotably mounted at post 120 to base 111. First end 119(*a*) of pivot bar 118 engages cam surface 116, such that pressing actuator 110 into base 111 depresses cam surface 116 against first end 119(*a*), causing pivot bar 118 to pivot about post 120. As pivot bar 118 pivots about post 120, second end 119(*b*) of pivot bar 118 pushes against stop surface 113 on push lever 112, pushing push lever 112 outward though wall 115 of base 111 and to the extended position shown in FIG. 15. Once actuator 110 is released, as actuator 110 moves upward, a pivot bar spring 122 (which is attached at a first end to base spring connector 124 and at a second end to pivot bar spring connector 126) pivots pivot bar 118 back to its ready position (shown in FIG. 14). An additional spring member (not shown) is also provided between base 111 and push lever 112 that biases push lever 112 back to its ready position (shown in FIG. 14) as pivot bar 118 returns to its ready position.

As mentioned above, exit opening 222 of obstacle 200 is configured to allow a toy vehicle to pass through obstacle 200. However, when obstacle 200 is pivoted a sufficient amount so that a vehicle launching off of ramp 104 will impact the front, bottom surface 224 of obstacle 200, such front, bottom surface 224 will stop the toy vehicle, preventing it from passing through perforated opening 222, and leaving it trapped in obstacle 200. A user that desires to capture a toy vehicle in the obstacle 200 must therefore time their activation of actuator 110, and adjust the speed with which they push actuator 110, so as to pivot obstacle 200 by the correct amount and at the correct time so that the toy vehicle will be blocked by front, bottom surface 224, and thus caught in obstacle 200.

Once again, once a toy vehicle is caught within obstacle 200, the added weight of the toy vehicle held in obstacle 200 will cause carrier 204 to pivot toward moveable carriage 205 and tower 202, releasing an internal catch that holds carriage 205 in place in the lowered position of FIG. 5, and allowing an internal spring to lift carriage 205, FIG. 206, and obstacle 200 (now carrying a toy vehicle) upward and out of the travel path of racetrack 100. FIGS. 8*a*-8*e* provide schematic views of the various stages of movement of moveable carriage 205, FIG. 206, and obstacle 200, while FIGS. 9-13 provide various detail views of moveable carriage 205, carrier 204, and tower 202.

As shown in FIG. 8(*a*), moveable carriage 205 and FIG. 206 are initially in their raised position (shown in detail in FIG. 11). A portion of moveable carriage 205 extends through a slot 231 in tower 202. A carriage-mounted spring attachment hub 232 is attached to moveable carriage 205. A tower-mounted spring attachment hub 236 is likewise attached to the inside of tower 202 adjacent slot 231, and an expansion spring 234, such as a coil spring, extends between attachment hubs 232 and 236. Carrier 204 is pivotably attached to moveable carriage 205 on the outside of tower 202 at pivot connection 210, and a compression spring 212 is situated between carrier 204 and carriage 205 to bias carrier 204 slightly outward from carriage 205. A portion of carrier 204 also extends through slot 231 and forms a latch 238 on the inside of tower 202, which latch 238 is moveable in unison with carrier 204. Thus, as carrier 204 pivots toward carriage 205 and tower 202, latch 238 likewise moves slightly away from an interior wall 203 of tower 202.

A fixed catch surface 214 is provided on the interior wall 203 of tower 202. Fixed catch surface 214 is vertically positioned so that when moveable latch 238 is positioned just below and engaged with fixed catch surface 214, obstacle 200 will be positioned in the lowered position shown in FIG. 5.

As shown in FIG. 8(*b*), in order to move obstacle 200 to the lowered position of FIG. 5, a user may simply press down on the uppermost portion of moveable carriage 205, in turn moving each of FIG. 206, carrier 204, and obstacle 200 downward. As those elements are moved downward, expansion spring 234 is expanded, biasing moveable carriage 205 back toward the top of tower 202. The user may continue to push carriage 205 downward until, as shown in FIG. 8(*c*) and in the close-up view of FIG. 12, moveable latch 238 on figure base 204 slips below fixed catch surface 214 on the interior wall 204 of tower 202. At this position, fixed latch 214 will hold moveable latch 238 in place, and thus hold FIG. 206 and obstacle 200 in the lowered position of FIG. 4, with expansion spring 234 biasing carriage 205 upward toward the top of tower 202. Also in this position, carrier 204 remains slightly pivoted outward from carriage 205 and the outer wall of tower 202 as a result of a compression spring 212, the spring characteristics (size, spring constant) of which are selected so as to provide just enough outward biasing force to overcome the weight of the FIG. 206 and obstacle 200 while holding carrier 204 in a slightly outwardly angled position with respect to carriage 205 (as shown in detail in FIG. 10).

As shown in FIG. 8(*d*), once a toy vehicle 300 has been captured by obstacle 200 as described above, the added weight of the toy vehicle 300 overcomes the force exerted by compression spring 212 on the underside of carrier 204, causing carrier 204 (and FIG. 206) to pivot toward tower 202 and carriage 205 about pivot connection 210. Such pivoting of carrier 204 in turn causes moveable latch 238 on carrier 204 to disengage from fixed catch surface 214 on interior wall 203 of tower 202. As shown in FIG. 8(*e*), once moveable latch 238 on figure base 204 has disengaged from fixed catch surface 214, expansion spring 234 retracts, in turn pulling carriage 205, carrier 204, FIG. 206, and obstacle 200 (now carrying toy vehicle 300) upward to the raised position shown in FIG. 4 and out of the racing path of racetrack 100, such that any other vehicles on the track may continue uninhibited.

As an alternative to the latch assembly discussed above or in addition thereto, FIG. 206 and obstacle 200 may be moved between their raised and lowered positions manually by a child during play. For instance, a flywheel and gear rack may be manipulated to move the FIG. 206 and obstacle 200 up and down. As yet another alternative, FIG. 206 and obstacle 200 may be moved up and down automatically via a ratchet mechanism that is driven by a motor.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A toy racetrack comprising:

an endless loop toy vehicle path;

a variably positionable obstacle mounted for positioning within and outside of said toy vehicle path and being biased via a biasing element toward a position outside of said toy vehicle path, and when positioned within said toy vehicle path, the obstacle being selectively positionable via a user-operable actuator between a first orientation that allows a toy vehicle to pass completely through said obstacle and a second orientation in which obstacle is impacted by the toy vehicle traveling within the obstacle and the toy vehicle is captured in said obstacle;

a latch configured to releasably hold said obstacle within said toy vehicle path, said latch being responsive to a toy vehicle impacting a portion of the obstacle and being captured in said obstacle so as to release said obstacle from said latch, said obstacle and the toy vehicle captured therein being moved by the biasing element to said position outside of said toy vehicle path.

2. The toy racetrack of claim 1, further comprising a vertically moveable figure, wherein said obstacle is pivotably mounted to said figure.

3. The toy racetrack of claim 2, wherein the user-operable actuator comprises a lever positioned to pivot said obstacle to said second orientation.

4. The toy racetrack of claim 3, said obstacle further comprising an exit opening on a side of said obstacle configured to allow a toy vehicle to pass through said obstacle when said obstacle is in said first orientation, and a closed portion below said exit opening configured to prevent a toy vehicle from passing through said obstacle when said obstacle is pivoted to said second orientation.

5. The toy racetrack of claim 2, wherein said figure is pivotably mounted to a vertically moveable carriage.

6. The toy racetrack of claim 5, wherein said figure is spring biased away from said moveable carriage.

7. The toy racetrack of claim 5, wherein said figure is configured to pivot toward said moveable carriage when a toy vehicle is captured in said obstacle.

8. The toy racetrack of claim 1, wherein said obstacle is moveably mounted to a vertically moveable carriage, said latch further comprising a first latch portion attached to said carriage and a second latch portion attached to a support moveably mounting said moveable carriage, wherein said first latch portion is configured to disengage from said second latch portion upon capture of a toy vehicle in said obstacle.

9. A toy racetrack comprising:

an endless loop toy vehicle path;

a variably positionable obstacle mounted for positioning, via a user-operable actuator, in a first position within said toy vehicle path and in a second position outside of said toy vehicle path; and wherein the user-operable actuator configured to selectively move said obstacle from a first orientation, in the first position, that allows a toy vehicle to pass completely through said obstacle, to a second orientation, in the first position, in which the obstacle is impacted by the toy vehicle traveling within the obstacle and the toy vehicle is captured in said obstacle, said impact of the obstacle and capture of the toy vehicle in the obstacle initiating movement of the obstacle, and the toy vehicle captured therein, to its second position outside of said toy vehicle path.

10. The toy racetrack of claim 9, wherein said obstacle is biased toward said second position.

11. The toy racetrack of claim 9, wherein said obstacle is moveably mounted to a vertically moveable carriage, said obstacle further comprising an exit opening on a side of said obstacle configured to allow a toy vehicle to pass through said obstacle when said obstacle is in said first orientation, and a closed portion below said exit opening configured to prevent a toy vehicle from passing through said obstacle when said obstacle is moved to said second orientation.

12. The toy racetrack of claim 11, further comprising a first latch portion attached to said moveable carriage and a second latch portion attached to a support moveably mounting said moveable carriage, wherein said first latch portion is configured to disengage from said second latch portion upon capture of a toy vehicle in said obstacle.

13. The toy racetrack of claim 12, wherein said obstacle is biased toward said second position, and wherein disengagement of said first latch portion from said second latch portion causes said obstacle to move toward said second position.

14. The toy racetrack of claim 9, further comprising a vertically moveable figure, wherein said obstacle is pivotably mounted to said figure.

15. The toy racetrack of claim 14, wherein said figure is pivotably mounted to a vertically moveable carriage.

16. The toy racetrack of claim 15, wherein said figure is spring biased away from said moveable carriage.

17. The toy racetrack of claim 15, wherein said figure is configured to pivot toward said moveable carriage when a toy vehicle is captured in said obstacle.

18. A toy racetrack comprising:

a toy vehicle path;

a support;

a variably positionable obstacle mounted to the support, the obstacle being movable between a first position within the toy vehicle path and in a second position outside of the toy vehicle path; and a user-operable actuator engageable with the obstacle to selectively move the obstacle from a first orientation at the first position to a second orientation at the first position, the obstacle in the first orientation allowing a toy vehicle to pass completely through the obstacle, and the obstacle in the second orientation being impacted by the toy vehicle traveling within the obstacle and the toy vehicle being captured in the obstacle, said impact of the obstacle and capture of the toy vehicle in the obstacle causing movement of the obstacle, and the toy vehicle captured therein, to its second position outside of said toy vehicle path.

19. The toy racetrack of claim 18, wherein the obstacle is mounted to a carriage, and the obstacle further comprises:

an exit opening that allows a toy vehicle to pass through the obstacle when the obstacle is in the first orientation, and a closed portion below the exit opening that prevents a toy vehicle from passing through the obstacle when the obstacle is moved from its first orientation to its second orientation.

* * * * *